US009597882B2

(12) United States Patent
Gonzales et al.

(10) Patent No.: US 9,597,882 B2
(45) Date of Patent: Mar. 21, 2017

(54) CAP FOR A FLUID CONTAINER OUTLET

(75) Inventors: Curt Gonzales, Corvallis, OR (US); Daniel Fradl, Corvallis, OR (US); Mark A. Ramsdell, Corvallis, OR (US); Edward Savage, Kildare Leixlip (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 483 days.

(21) Appl. No.: 12/994,554

(22) PCT Filed: May 29, 2008

(86) PCT No.: PCT/US2008/065061

§ 371 (c)(1),
(2), (4) Date: May 13, 2011

(87) PCT Pub. No.: WO2009/145770

PCT Pub. Date: Dec. 3, 2009

(65) Prior Publication Data

US 2011/0259886 A1 Oct. 27, 2011

(51) Int. Cl.

| | |
|---|---|
| ***B65D 25/28*** | (2006.01) |
| ***B65D 53/00*** | (2006.01) |
| ***B41J 2/175*** | (2006.01) |

(52) U.S. Cl.

CPC ..... *B41J 2/17513* (2013.01); *B41J 2/1752* (2013.01); *B41J 2/17536* (2013.01); *B41J 2/17553* (2013.01)

(58) Field of Classification Search

USPC ..... 220/212.5, 200; 215/DIG. 2, 350–351, 215/347, 12.1, 12.2, 344

See application file for complete search history.

(56) References Cited

U.S. PATENT DOCUMENTS

| | | | | |
|---|---|---|---|---|
| 2,264,792 | A * | 12/1941 | Gray et al. | 215/331 |
| 3,825,143 | A * | 7/1974 | Julian | 215/206 |
| 5,555,988 | A * | 9/1996 | Koch et al. | 215/249 |
| 7,163,115 | B2 * | 1/2007 | Whitley | 215/276 |

FOREIGN PATENT DOCUMENTS

| | | | |
|---|---|---|---|
| EP | 0029729 | A1 | 6/1981 |
| JP | 10-291326 | | 11/1998 |
| JP | 2000-127424 | A | 5/2000 |
| JP | 2001-26117 | A | 1/2001 |

* cited by examiner

*Primary Examiner* — Anthony Stashick
*Assistant Examiner* — Kaushikkumar Desai
(74) *Attorney, Agent, or Firm* — HP Inc. Patent Department

(57) ABSTRACT

In one embodiment a fluid container includes a housing having a chamber therein for holding a fluid and an outlet from the chamber; and a cap capping the outlet. The cap includes a contact surface thereon contacting an interior surface of the outlet and a void therein adjacent to the contact surface such that a portion of the cap underlying the contact surface may flex into the void.

15 Claims, 7 Drawing Sheets

CAP FOR A FLUID CONTAINER OUTLET

RELATED APPLICATIONS

The present application claims the priority under 35 U.S.C. 119(a)-(d) or (f) and under C.F.R. 1.55(a) of previous International Patent Application No.: PCT/US2008/065061, filed May 29, 2008, entitled "Cap for a Fluid Container Outlet", which application is incorporated herein by reference in its entirety.

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer. Alternatively, one or more printheads may be mounted on a stationary carriage, as in a page-wide printhead array. A printhead may be an integral part of an ink cartridge or part of a discrete assembly to which ink is supplied from a separate, often replaceable ink container. For printhead assemblies that utilize replaceable ink containers, it is desirable to keep the outlet from the ink container sealed during packaging, shipping and storage to prevent ink leaking from the container.

DRAWINGS

FIGS. 1 and 2 show the ink container in an upright orientation indicating the orientation of the ink container if it were installed in a printer.

FIGS. 3 and 4 show the ink container upside down indicating an orientation of the ink container for removing the shipping cap. The shipping cap is partially exploded away from the container in FIGS. 2 and 4.

Figure 6:
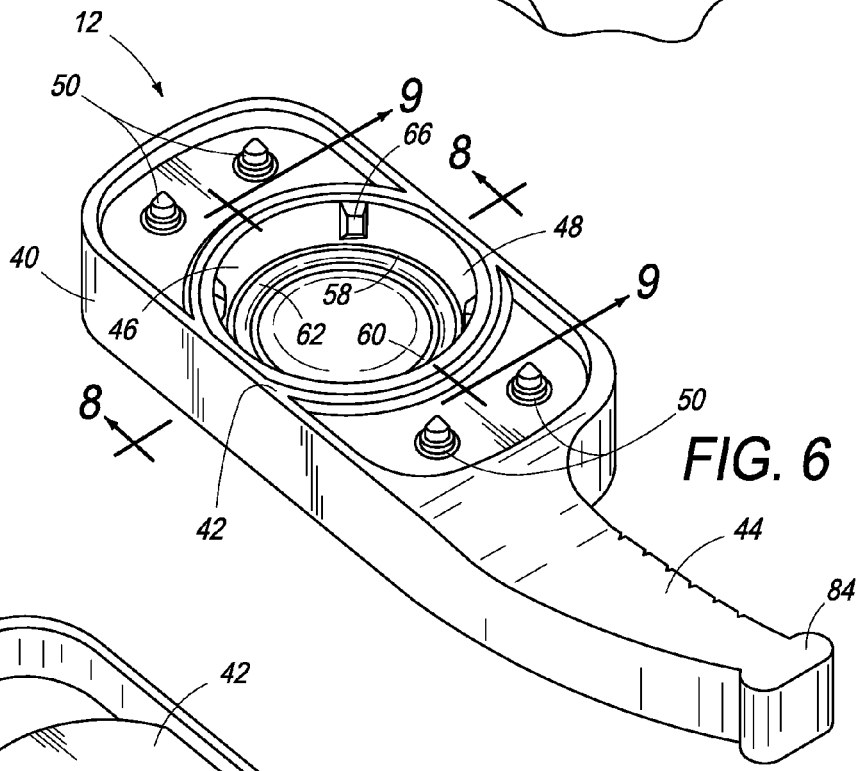
FIGS. 6 and 7 are perspective views showing the inside and outside, respectively, of one embodiment of a shipping cap for capping the outlet shown in FIG. 5.
Figure 8:
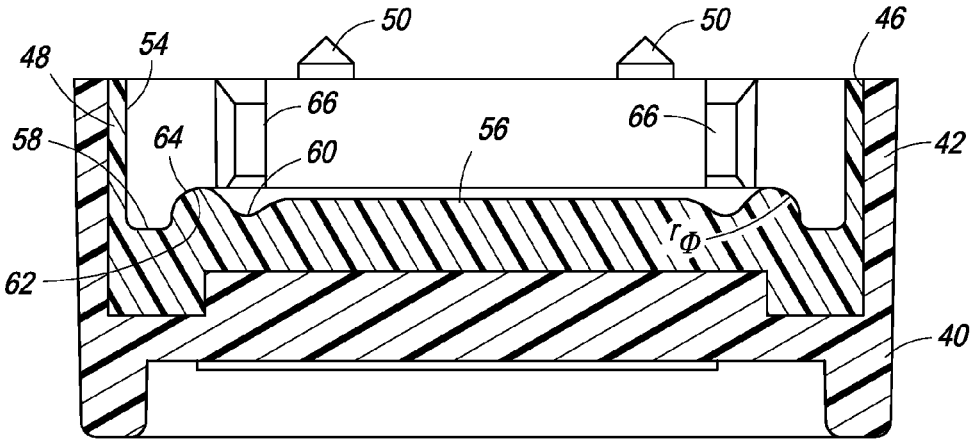
Figure 9:
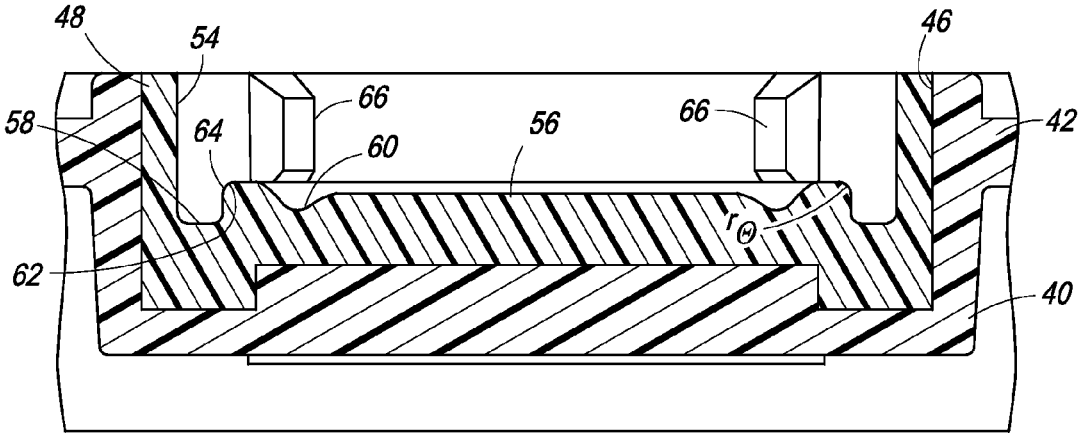

FIGS. 8 and 9 are section views taken along the lines 8-8 and 9-9 in FIG. 6.

Figure 7:
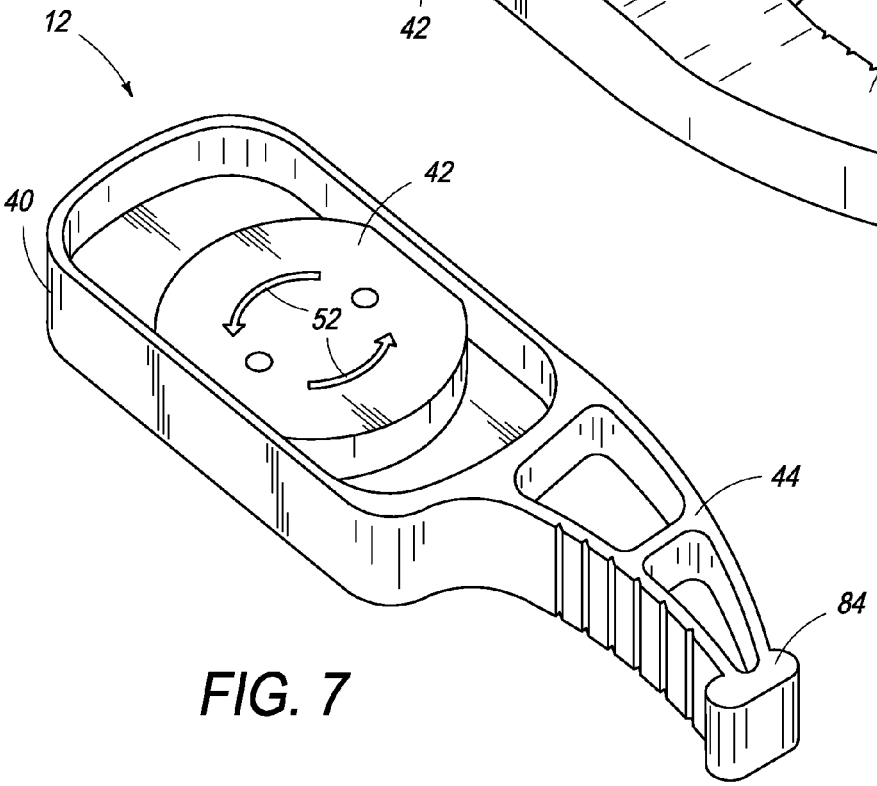
Figure 10:
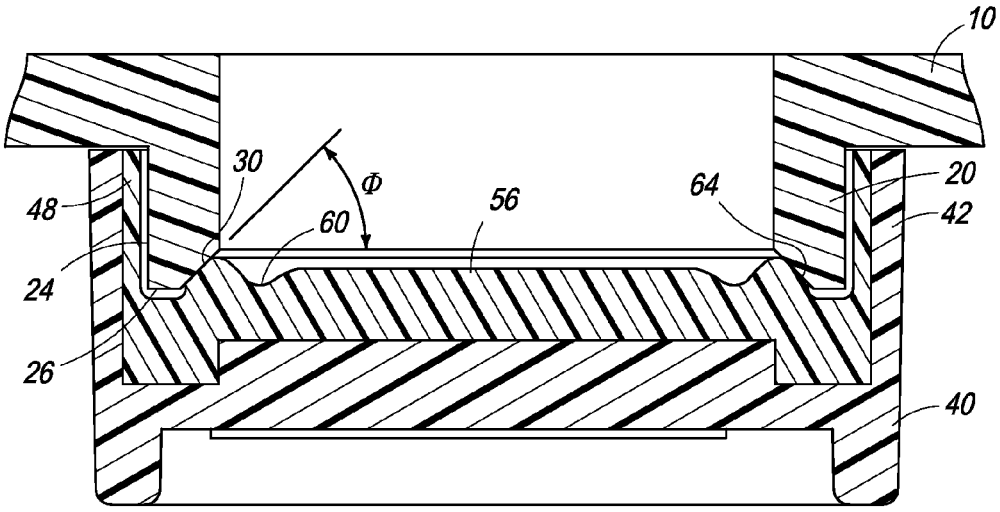
Figure 11:
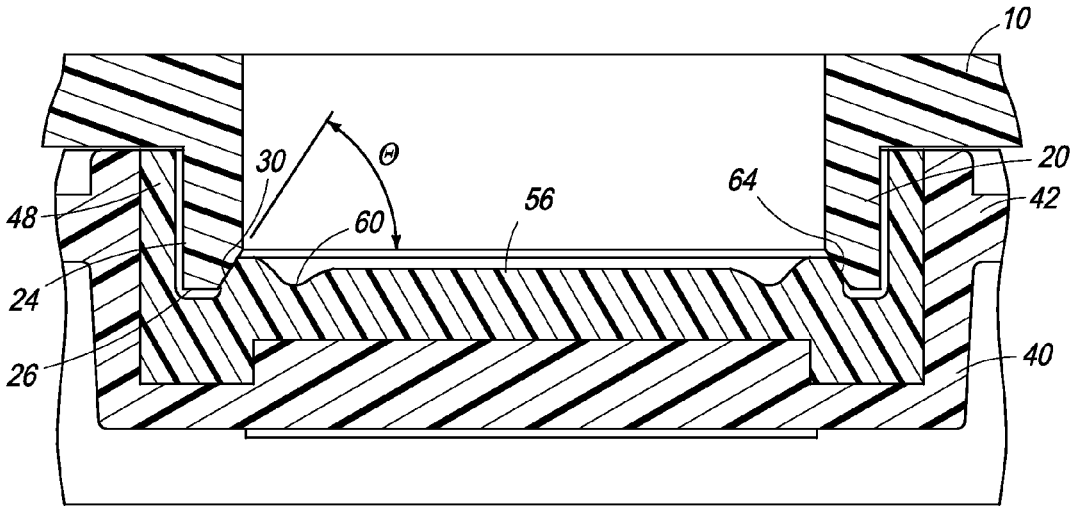

FIGS. 10 and 11 are section views corresponding to the sections shown in FIGS. 8 and 9 showing the shipping cap of FIGS. 6-7 in place on a container outlet.

Figure 12:
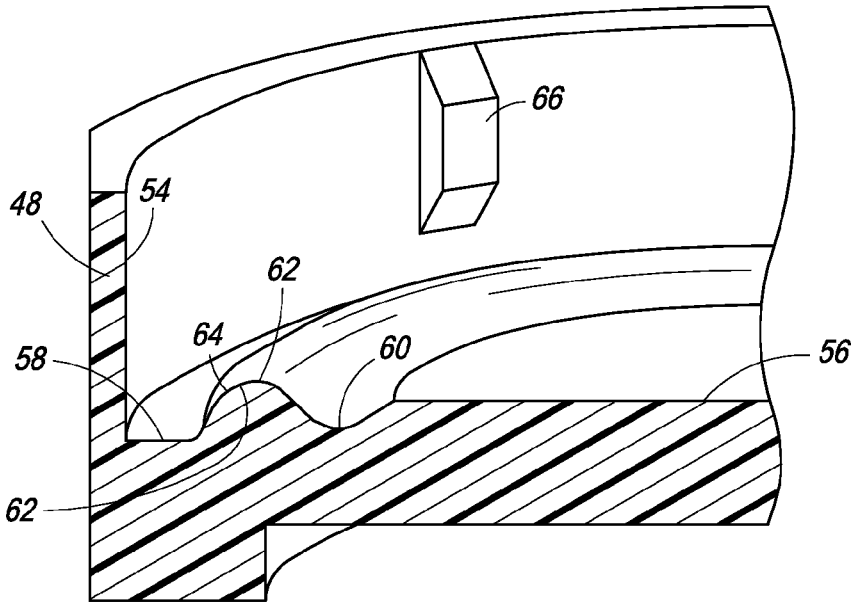

FIG. 12 is close-up perspective, partial section view showing a portion of the inside of the shipping cap of FIGS. 6-7.

Figure 13:
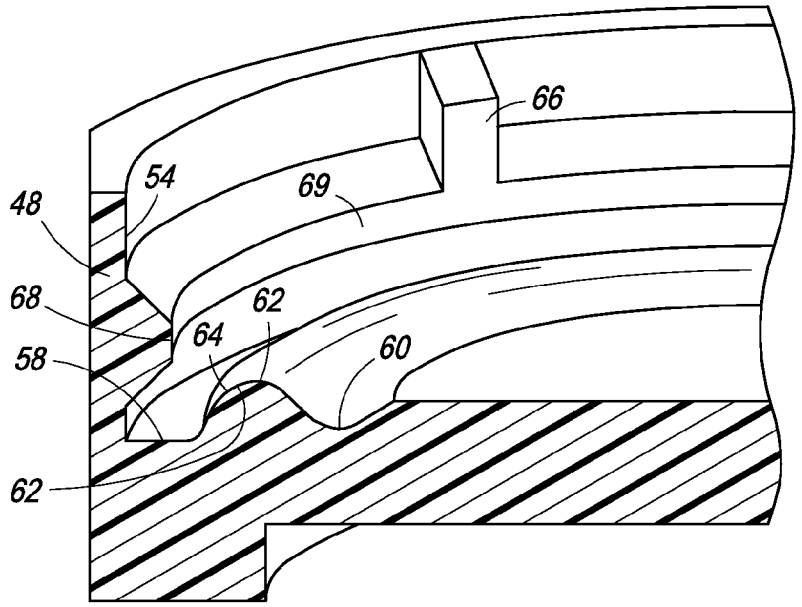

FIG. 13 is close-up perspective, partial section view showing a portion of the inside of a shipping cap according to another embodiment of the disclosure.

Figure 14:
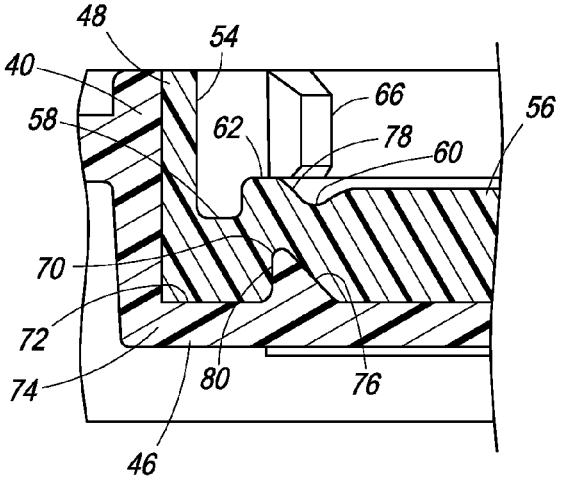

FIG. 14 is a section view showing a portion of the inside of a shipping cap according to another embodiment of the disclosure.

Figure 15:
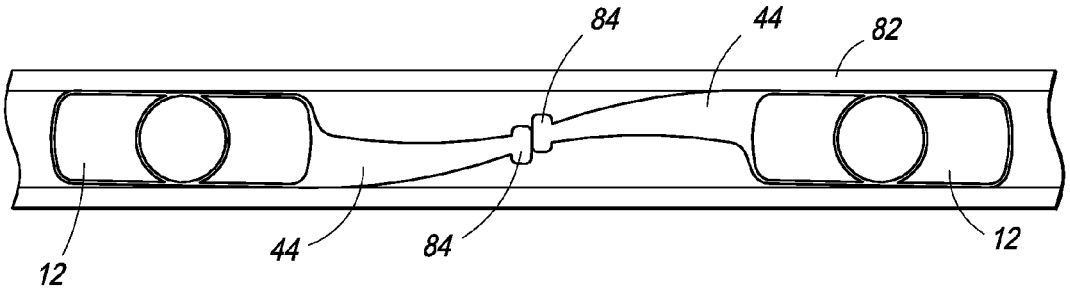

FIG. 15 is a plan view showing two shipping caps as they might be arranged in a bulk feeding device for assembly to an ink container.

DESCRIPTION

Embodiments of the present disclosure were developed as part of an effort to design a protective cap that reliably seals the outlet of a replaceable inkjet printer ink container despite dimensional variations within the manufacturing tolerances for the cap and the container outlet, and throughout a range of environmental conditions likely to be experienced during packaging, shipping and storage. Exemplary embodiments of the disclosure will be described, therefore, with reference to a protective cap for a replaceable inkjet printer ink container. Embodiments of the disclosure, however, are not limited to inkjet ink containers. Other forms, details, and embodiments may be made and implemented. Hence, the following description should not be construed to limit the scope of the disclosure, which is defined in the claims that follow the description.

Figure 1:
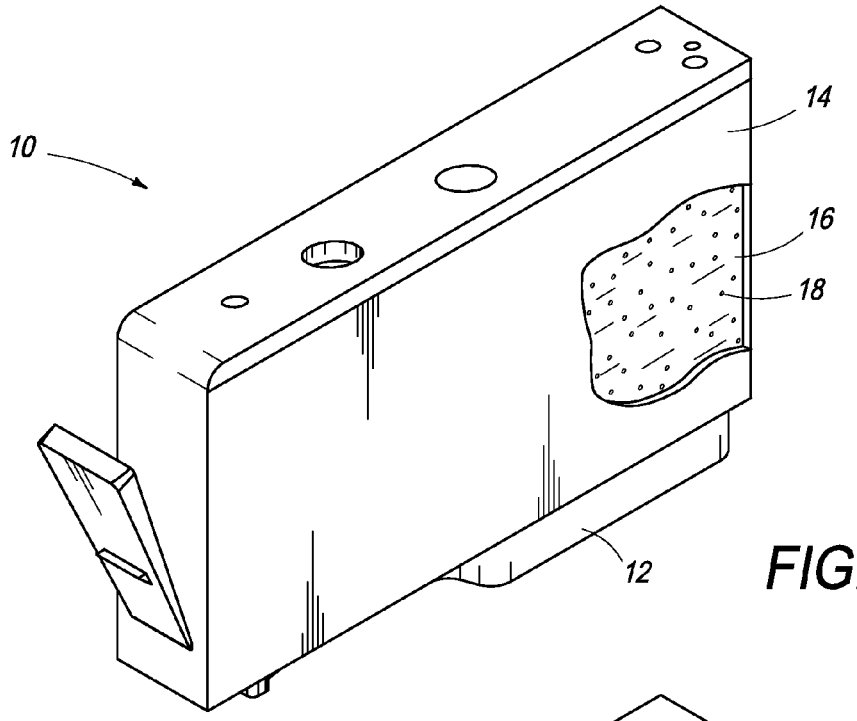
FIGS. 1-4 are perspective views illustrating an ink container and shipping cap according to one embodiment of the disclosure.
Figure 2:
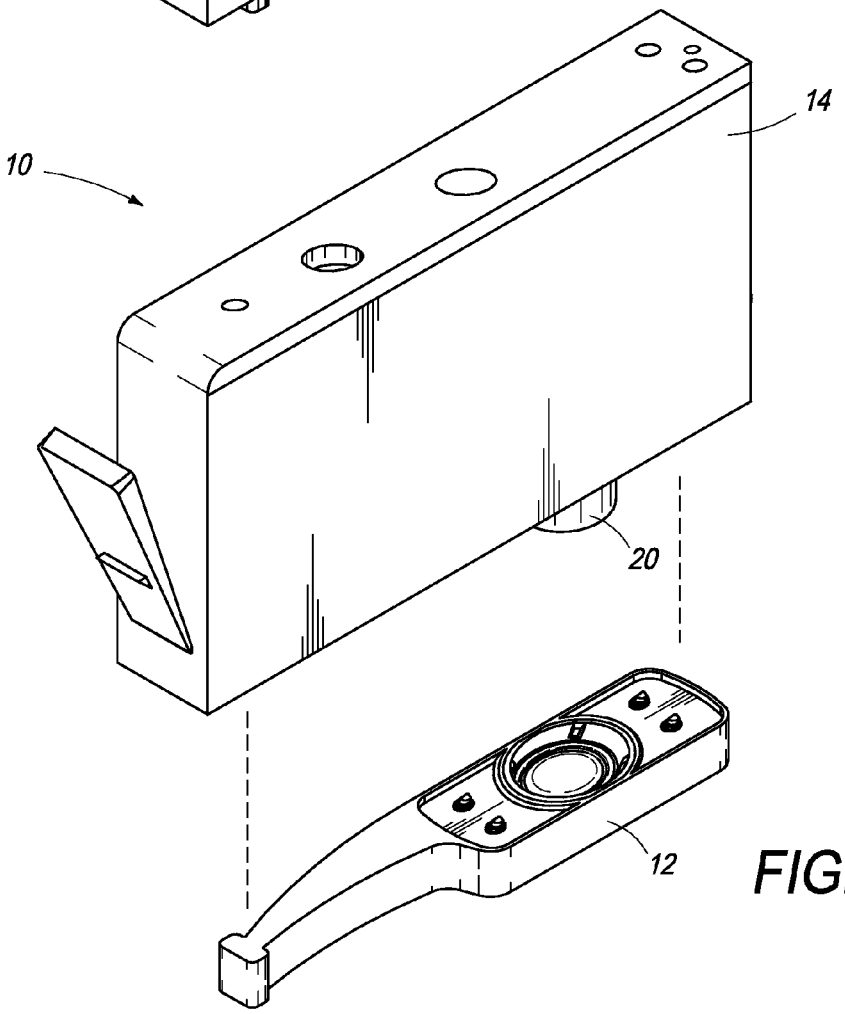
Figure 3:
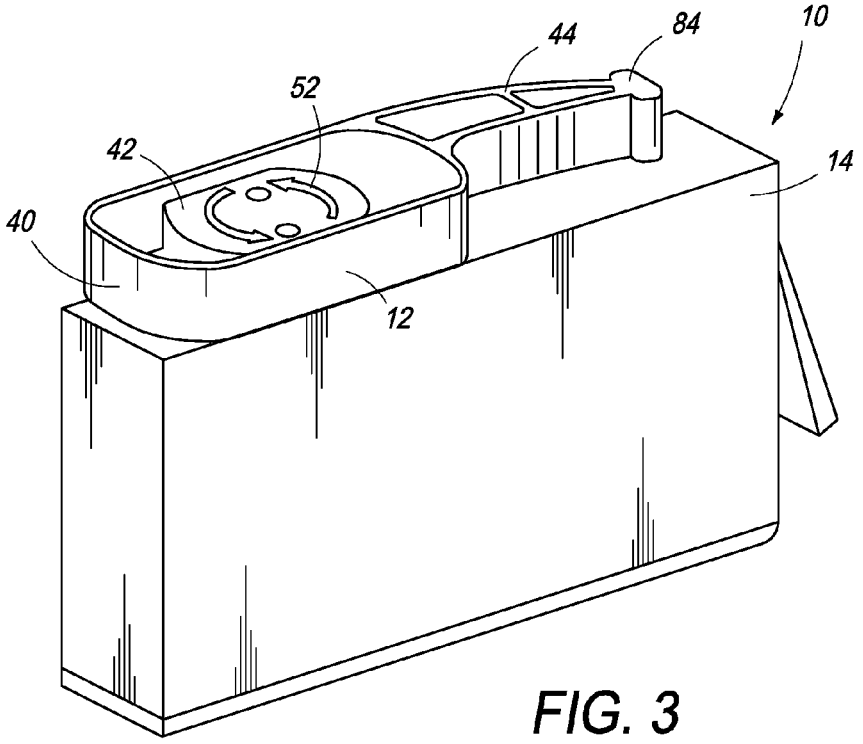
Figure 4:
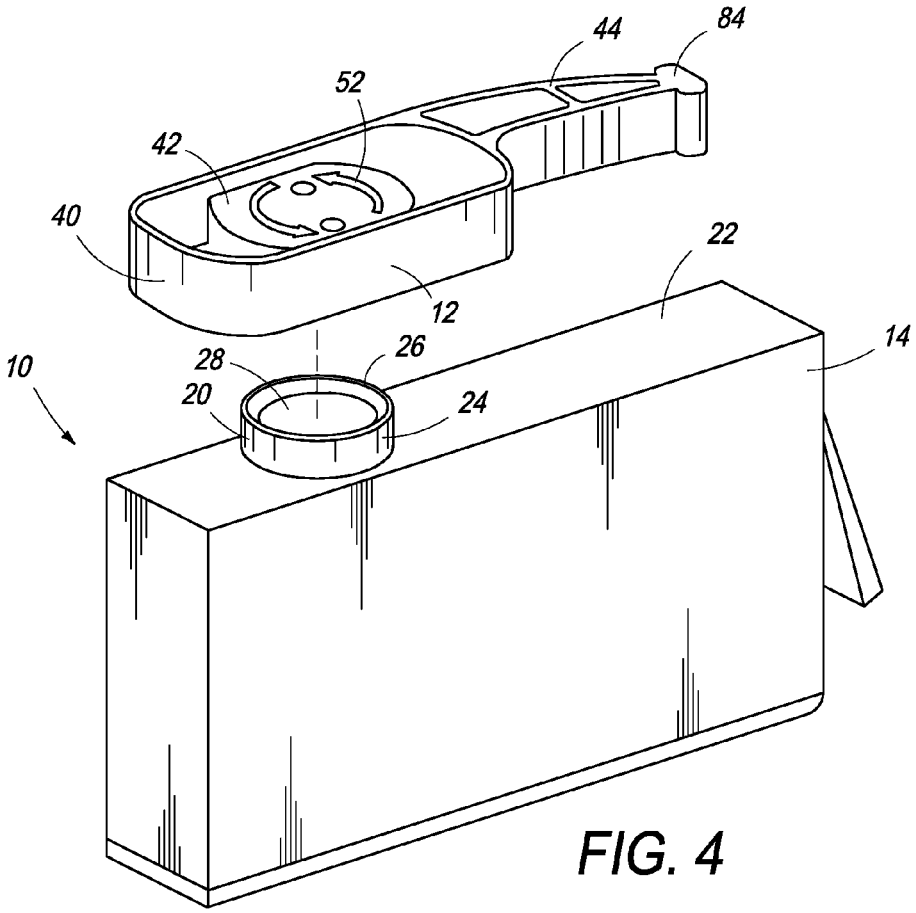

FIGS. 1-4 are perspective views illustrating an ink container 10 and a protective cap 12 according to one embodiment of the disclosure. FIGS. 1 and 2 show ink container 10 in an upright orientation indicating the orientation of container 10 if it were installed in a printer. FIGS. 3 and 4 show ink container 10 upside down indicating an orientation of container 10 for removing cap 12. Protective cap 12 is partially exploded away from container 10 in FIGS. 2 and 4. Referring to FIGS. 1-4, container 10 includes a housing 14 that forms an internal chamber 16 for holding ink. Ink may be held in chamber 16 in a foam block 18 or other suitable ink holding material. Ink flows from container 10 to a printhead or other downstream component through an outlet 20 at the bottom of housing 14. Protective cap 12 is designed to keep outlet 20 sealed during packaging, shipping and storage to prevent ink leaking from container 10. Cap 12 is commonly referred to as a ship cap or shipping cap.

Figure 5:
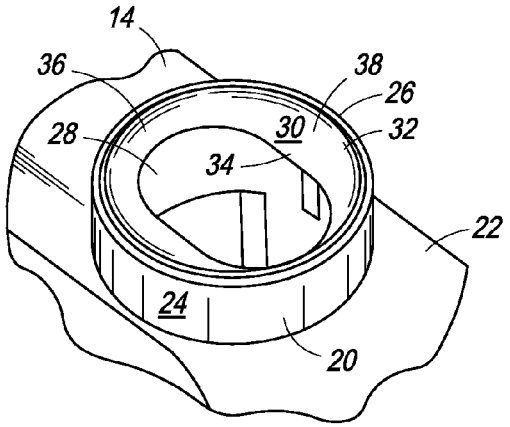
FIG. 5 is a close-up perspective view of one embodiment of an outlet for an ink container such as the ink container shown in FIGS. 1-4.

FIG. 5 is a close-up view of container outlet 20. FIGS. 6 and 7 are close-up views showing the inside and outside of shipping cap 12. Referring first to FIG. 5, outlet 20 protrudes from a bottom part 22 of container housing 12. In this embodiment of container outlet 20, the outer surface 24 and rim 26 of outlet 20 are circular and the opening 28 into ink chamber 16 is oval. Thus, an inner, facing surface 30 of outlet 20 transitions from a circular outer part 32 at rim 26 to an oval inner part 34 at opening 28. Accordingly, the slope of facing surface 30 varies between a steeper slope along the rounded ends of opening 28 at contour areas 36 and a more gradual slope along the straight sides of opening 28 at contour areas 38.

Referring now to FIGS. 6 and 7, ship cap 12 includes a comparatively rigid plastic shell 40 forming a body 42 and a handle 44 that extends out away from body 42. A cavity 46 in body 42 is lined with a more flexible, elastomeric liner 48. Cap 12 may be fabricated, for example, using a so-called "two shot" molding process in which shell 40 is molded first and then liner 48 is molded into shell 40. Container outlet 20 fits into cavity 46 and seals against liner 48 as described in detail below. Cap 12 may be attached to container housing 14, for example, by ultrasonically welding a series of posts 50 on cap 12 to housing bottom 22. Posts 50 are positioned around the outlet receiving cavity 46. Cap 12 is pressed on to outlet 20 and welded at posts 50. Posts 50 are configured to retain cap 12 on container 10 with sufficient pressure to maintain the seal between liner 48 and outlet 20 while still allowing the user to easily remove cap 12 by twisting, as indicated by arrows 52 in FIG. 7. Shell handle 44 facilitates twisting cap 12 off container 10. The number, size and position of posts 50 may be varied as desirable to achieve the dual purpose of maintaining sealing pressure and allowing easy removal.

FIGS. 8 and 9 are section views of cap 12 taken along the lines 8-8 and 9-9 in FIG. 6. FIGS. 10 and 11 are section views corresponding to the sections shown in FIGS. 8 and 9 showing cap 12 in place on container outlet 20. FIG. 12 is close-up perspective, partial section view showing a portion of shipping cap liner 48. Referring to FIGS. 8-12, liner 48 includes a sidewall 54 and an undulating floor 56 adjoining sidewall 54. A pair of concentric depressions 58, 60 are formed in floor 56 on opposite sides of an annular ridge 62. Outer depression 58 is configured as a groove formed along sidewall 54. Inner surface 30 of outlet 20 along rim 26 engages the outer periphery of ridge 62 at outer groove 58 along a contact surface 64, as shown in FIGS. 10 and 11. It is desirable to make outer groove 58 deep enough so that outlet rim 26 does reach the bottom of groove 58, to help ensure full contact between outlet inner surface 30 and liner contact surface 64.

Inner depression 60 is configured as a shallow groove along the inner periphery of ridge 62. Inner groove 60 allows ridge 62 to flex inward when outlet surface 30 is pressed into ridge contact surface 64. In a conventional shipping cap seal, there is no such relief to the inside of the contact surface when the container outlet is pressed into the elastomeric seal. Elastomers are virtually incompressible. Thus, where no relief is provided, there may be little compliance between the container outlet and the elastomeric contact surface unless very high compression forces are applied and maintained, pressing the outlet into the contact surface. High compression forces, however, are not desirable (and may not be realistic) for small plastic parts like an ink container outlet and shipping cap. Thus, a conventional seal is subject to failure due to dimensional variations in, or deformation of, the outlet or cap (or both). Embodiments of the new seal, in which inner depression 60 provides an area of relief into which ridge 62 may flex, accommodate greater dimensional variation in the parts without high compression forces, while still maintaining a good seal.

The extent to which ridge 62 may flex is determined largely by the shape of ridge 62, the depth of inner depression 60 and the characteristics of the elastomer used to form liner 48. Although the degree of flex desirable may vary depending on the particular capping implementation, it is expected that, for a typical ink container ship cap implementation using a thermoplastic elastomer, a Santoprene brand thermoplastic vulcanizate with a Shore A durometer of about 35 for example, the following geometries will provide a reliable seal at moderate compression forces (50 N or below, for example).

Depth of inner depression 60≈0.4 mm (from the surface of floor 56).

Width (radially) of inner depression 60≈1.0 mm.

Height of ridge 62 above depression 60≈0.65 (≈0.25 mm above the surface of floor 56).

As noted above, the slope of facing, inner surface 30 of outlet 20 varies between a steeper slope along the rounded ends of opening 28 at contour areas 36 and a more gradual slope along the straight sides of opening 28 at contour areas 38. A sharper corner having a smaller corner radius (or other curve) on ridge 62 helps match the geometry of contact surface 64 to the steeper contour areas 36 for a better seal. Similarly, a more rounded corner having a larger corner radius (or other curve) on ridge 62 helps match the geometry of contact surface 64 to the less steep contour at areas 38 for a better seal. These varying corner radii are illustrated in the section views at gradual contour areas 38 shown in FIGS. 8 and 10 and in the section views at steeper contour areas 36 shown in FIGS. 9 and 11. Referring to FIG. 10, outlet inner surface 30 inclines at a less steep angle $\phi$ along section line 8-8 in FIG. 6, which corresponds to outlet contour areas 38 in FIG. 5. Referring to FIG. 11, outlet inner surface 30 inclines at a steeper angle $\theta$ along section line 9-9 in FIG. 6, which corresponds to outlet contour areas 36 in FIG. 5. Accordingly, as best seen in FIGS. 8 and 9, a corner radius at contact surface 64 is greater at the locations corresponding to angle $\phi$ ($r_\phi$ in FIG. 8) and smaller at the locations corresponding to angle $\theta$ ($r_\theta$ in FIG. 9). The corner radius at any particular location around ridge contact area 64 will vary within the range $r_\phi$-$r_\theta$ according to the corresponding contour on outlet inner surface 30.

Referring to FIGS. 6, 8, 9 and 12, a series of alignment ribs 66 protrude from sidewall 54 above ridge 62 to help center outlet 20 on ridge 62. The use of alignment ribs 66 is possible, and their benefits realized, because the seal is achieved fully at the interface between outlet inner surface 30 and contact surface 64. That is to say, the seal does not depend on contact between outlet rim 26 (and/or outlet outer surface 24) and cap liner 48. Thus, a series of four ribs 66 spaced even around sidewall 54, for example, will help keep outlet 20 centered on, and sealed against, ridge 62 despite dimensional variations in the parts that may result from manufacturing tolerances. In an alternative embodiment shown in FIG. 13, a continuous alignment rib 68 extends all the way around sidewall 54. A continuous rib 68 helps center outlet 20 on ridge 62 and provides a second contact surface 70 for sealing against outer surface 24 of outlet 20. A continuous rib 68, however, may generate suction sufficient to draw ink out of outlet 20 when cap 12 is removed from container 10. Thus, a continuous rib 68 may not be desirable in some implementations for ship cap 12.

FIG. 14 illustrates another embodiment in which body 42 of shell 40 is configured to avoid the formation of knit lines when molding liner 48. A "knit line" in an injection molded part is a tiny crack created when two separate flows of the elastomer meet within the mold and solidify along an interface between flows, instead of flowing completely together. Knit lines in the elastomeric liner material forming contact surface 64 may compromise the integrity of the seal, allowing leakage. Referring to FIG. 14, an annular ridge 70 is formed on an otherwise flat surface 72 at the bottom 74 of cavity 46 in shell body 42. Ridge 70 forms a protruding ring under liner ridge 62. In the embodiment shown, an inner part 76 of the triangular ridge 70 slopes up from bottom surface 72 at substantially the same angle as an inner part 78 of liner ridge 62, and an outer part 80 is parallel to liner sidewall 54 (perpendicular to bottom surface 74). It has been observed that ridge 70 in shell body cavity 46 will reduce the risk of knit lines forming in ridge 62 at contact surface 64 compared with the stepped topography for cavity bottom 74 shown in FIGS. 8-11.

FIG. 15 is a plan view showing two shipping caps 12 as they might be arranged in an assembly feed track 82 in a bulk feeding operation for assembly to an ink container 10. It has been observed that cap handles that taper to a narrow end are prone to overlap one another and jam in a feed track 82, requiring operator intervention to clear the jam. A T-shaped end 84 of shell handle 44 on each ship cap 12 helps prevent caps 12 from overlapping one another in track 82, reducing the risk of a jam during automated part handling operations.

As noted at the beginning of this Description, the exemplary embodiments shown in the figures and described above illustrate but do not limit the disclosure. Other forms, details, and embodiments may be made and implemented. The foregoing description, therefore, should not be construed to limit the scope of the disclosure, which is defined in the following claims.

What is claimed is:

1. A fluid container, comprising:

a housing having a chamber therein for holding a fluid and an outlet from the chamber;

a cap capping the outlet, the cap comprising a shell and an elastomeric liner lining a recessed part of the shell, the liner including:

a cylindrical sidewall;

a floor;

a first annular groove in the floor for receiving the outlet;

a circular contact surface on the floor facing the sidewall and extending around one side of the first annular groove, the circular contact surface contacting an interior surface of the outlet; and a second annular groove in the floor inside of and concentric with the first annular groove, the second annular groove configured to allow the floor to flex when pressure is applied to the circular contact surface:

wherein said circular contact surface includes a curved surface with a radius of curvature that varies around a circumference of said circular contact surface.

2. The container of claim 1, wherein the liner further includes an alignment rib protruding from the sidewall to center the outlet on the circular contact surface when the cap is installed on the outlet.

3. The container of claim 2, wherein the alignment rib comprises a plurality of ribs spaced apart from one another around the sidewall.

4. The container of claim 2, wherein the alignment rib comprises a single continuous rib around the sidewall.

5. The container of claim 1, wherein the circular contact surface comprises a curved surface on a protruding corner of the floor, the curve of the corner surface varying between a sharper curve at diametrically opposed first locations and a more rounded curve at diametrically opposed second locations.

6. The container of claim 1, wherein the shell includes a body forming the recessed part of the shell and a handle extending out from the body to a T-shaped terminal end of the handle.

7. The container of claim 1, wherein the shell includes a body forming the recessed part of the shell and a handle extending out from the body, the handle tapering from a more broad part at the body to a more narrow part at a T-shaped end of the handle.

8. The container of claim 1, wherein the shell includes a body forming the recessed part of the shell, the body including an annular ridge protruding into the liner directly under the circular contact surface.

9. The container of claim 8, wherein the shell includes a ring protruding into the liner under the circular contact surface.

10. The container of claim 1, wherein the shell includes a body forming the recessed part of the shell, the body including an annular ridge protruding into the liner under the circular contact surface.

11. The container of claim 10, wherein an inner part of the annular ridge slopes up at an angle substantially the same as an angle of an inner part of the second annular groove.

12. The container of claim 10, wherein an outer part of the annular ridge is parallel to the cylindrical sidewall.

13. The container of claim 1, wherein the outlet has an oval shape and said radius of curvature is larger in areas corresponding to a steeper contour on said oval shape of said outlet.

14. The container of claim 8, wherein:

an inner part of the annular ridge slopes up at an angle substantially the same as an angle of an inner part of the second annular groove; and an outer part of the annular ridge is parallel to the cylindrical sidewall.

15. A fluid container, comprising:

a housing having a chamber therein for holding a fluid and an outlet from the chamber;

a cap capping the outlet, the cap comprising a shell and an elastomeric liner lining a recessed part of the shell, the liner including:

a cylindrical sidewall;

a floor;

a first annular groove in the floor for receiving the outlet;

a circular contact surface on the floor facing the sidewall and extending around one side of the first annular groove, the circular contact surface contacting an interior surface of the outlet;

a second annular groove in the floor inside of and concentric with the first annular groove;

a flexible ridge formed between the first and second annular grooves, wherein the second annular groove allows the ridge to flex inward when the cap is engaging the outlet;

wherein said circular contact surface includes a curved surface with a radius of curvature that varies around a circumference of said circular contact surface.

* * * * *